United States Patent [19]

Matsuya

[11] 4,228,486

[45] Oct. 14, 1980

[54] MINIATURE ELECTRIC LIGHT BULB SETS FOR DECORATIVE ILLUMINATION

[75] Inventor: Ryosuke Matsuya, Tokyo, Japan

[73] Assignee: Towa Dengyo Co., Ltd., Tokyo, Japan

[21] Appl. No.: 965,414

[22] Filed: Dec. 1, 1978

[30] Foreign Application Priority Data

Mar. 23, 1978 [JP] Japan ..... 53/036253[U]

[51] Int. Cl.[3] ..... F21V 11/02

[52] U.S. Cl. ..... 362/237; 362/252; 362/806

[58] Field of Search ..... 362/211, 213, 237, 238, 362/240, 252, 806

[56] References Cited

U.S. PATENT DOCUMENTS

| | | | |
|---|---|---|---|
| 1,640,282 | 8/1927 | Migliaccio | 362/806 |
| 3,009,052 | 11/1961 | Holbrook | 362/806 |
| 3,036,206 | 5/1962 | Holbrook | 362/806 |
| 3,118,618 | 1/1964 | Holbrook | 362/806 |
| 3,714,414 | 1/1973 | Sternius | 362/806 |
| 3,723,723 | 3/1973 | Lerner | 362/806 |
| 4,107,767 | 8/1978 | Anquetin | 362/252 |

*Primary Examiner*—Peter A. Nelson

*Attorney, Agent, or Firm*—Armstrong, Nikaido, Marmelstein & Kubovcik

[57] ABSTRACT

Miniature electric light bulb sets for decorative illumination are prepared by branching out two electric wires from one attachment plug and further branching out each of said two electric wires into two further electric wires at respective branch plates and providing a group of miniature electric light bulbs grouped at each terminal of the respective branched wires, the improved miniature electric light bulb sets for decorative illumination being prepared by simplifying each component, and reducing the production costs while maintaining safety.

1 Claim, 10 Drawing Figures

MINIATURE ELECTRIC LIGHT BULB SETS FOR DECORATIVE ILLUMINATION

SUMMARY OF INVENTION

Conventional miniature electric light bulb sets for decorative illumination are prepared by branching out two electric wires from one attachment plug and further branching out each of said electric wires into two further electric wires at respective branch plates and providing a group of miniature bulbs grouped at each terminal of the respective branched wires.

This invention relates to an improved miniature electric light bulb sets for decorative illuminations, and more particularly to miniature electric light bulb sets for decorative illumination prepared by simplifying each component and lowering the production cost while maintaining safety.

DETAILED DESCRIPTION OF INVENTION

Figure 1A:
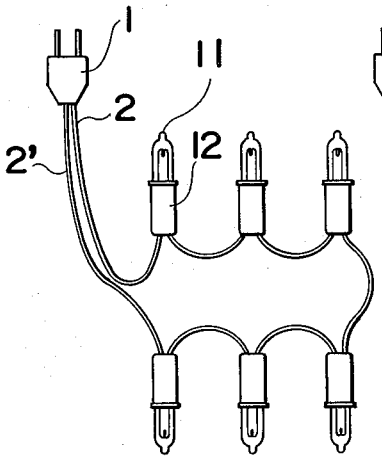
FIG. 1 A (PRIOR ART)
FIG. 1 A and B are side elevations showing the connected condition of the electric bulbs of a conventional type.

This invention relates to miniature electric light bulb sets for decorative illumination characterized in that two electric wires 2, 2' are branched out from an attachment plug 1, and a lead 3 of both electric wires and leads 5 5' of the separate two electric wires 4 and 4' are connected on a branch plate 6, and the entire branch plate is molded with a synthetic resin material 8 to form a sleeve 9, and several miniature electric light bulbs 11 forming a group are connected in series to a system of the electric wire 4, and similarly several miniature electric light bulbs 11' forming a group are connected in series to a system of the other electric wire 4', and both groups of miniature electric light bulbs 11 and 11' are connected in a parallel circuit.

Figure 1B:
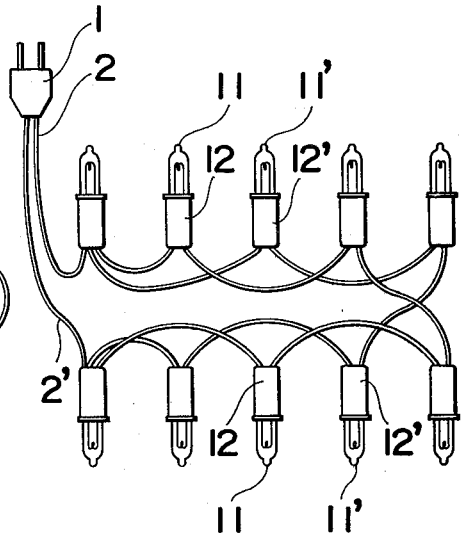
FIG. 1 B (PRIOR ART)

In conventional miniature electric light bulb sets for decorative illumination, as shown in FIG. 1A, a group of a miniature electric light bulbs 11, which are detachable from husk portion 12, are connected in series by means of a piece of vinyl electric wire so that each electric light bulb is sumultaneously flashed resulting in monotonous decorative illumination effect and less attractive to viewers. Also, the miniature electric light bulb sets for decorative illumination shown in FIG. 1B is an improved model shown in FIG. 1A, but this model is of a system wherein more than two groups of electric bulbs provided in a series circuit are provided which forms a parallel circuit as a whole, and flashing is performed for each series circuit. However, in this case, three pieces of vinyl electric wires are required to be connected to at least two husk portions which are branch terminal portions so that construction of the husk portion becomes complicated, and use of heavy wire specified in the regulations becomes difficult. Also, in case the husk portion is improved to be adapted to the regulation, the shape becomes large due to accommodation of a connecting portion of a terminal portion of a terminal plate in the husk portion, and moreover, even use of a crimp-type terminal for the connection of two pieces of vinyl electric wire becomes necessary resulting in more complicated structure and, therefore, the foregoing construction has disadvantages.

Figure 6:
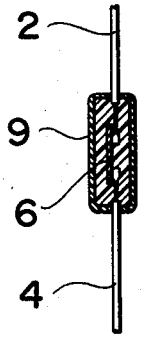
FIG. 6 is a cross section of the sleeve of another embodiment.

This invention will be described by referring to the drawings of the embodiment. The exposed lead 3 of each of the two pieces of vinyl electric wires 2 and 2' branched out from an attachment plug 1 is connected to a branch plate 6 with soldering (a), and leads 5 and 5' of separate vinyl electric wires 4 and 4' are soldered (a')to the same branch plate 6 to form a connection branching portion 7. The resultant connection branching portion 7 is molded by using a synthetic resin material 8 having insulating properties to form a sleeve 9, but a method of molding as shown in FIG. 6 may be employed which comprises setting the branch plate 6 into the housing, injecting and solidifying the synthetic resin solution.

Figure 7A:
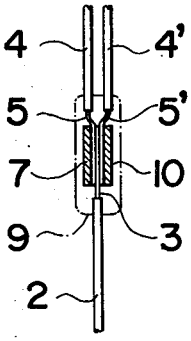
FIG. 7 A and B are explanatory views of another embodiment of the connection branching.
Figure 7B:
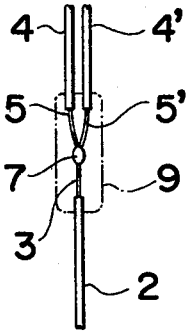

Next, the construction of the connection branching portion 7 is shown in FIG. 7A wherein the leads 5 and 5' of other electric wires are opposed to the lead 3 and the core portion is gripped with an electrically conductive pipe 10, and the connection branching portion is either molded or the lead 3 and other leads 5 and 5' are bonded as shown in FIG. 7B to form the connection branching portion 7, and this portion may be molded with the synthetic resin material 8.

Figure 2:
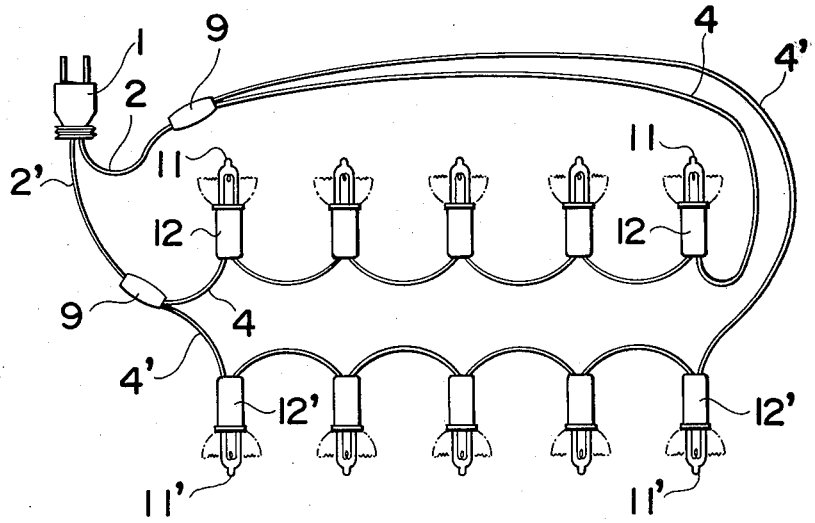
FIG. 2 is a side elevation showing the connected condition of wiring for the present invention.
Figure 3:
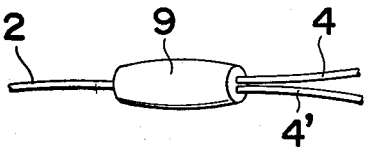
FIG. 3 is a perspective view of a branch sleeve.
Figure 5:
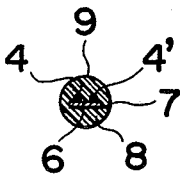
FIG. 5 is a cross section of the sleeve.
Figure 4:
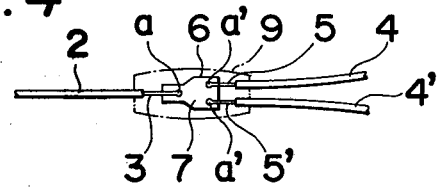
FIG. 4 is an elevation representing an internal structure of the branch sleeve.
Figure 8:
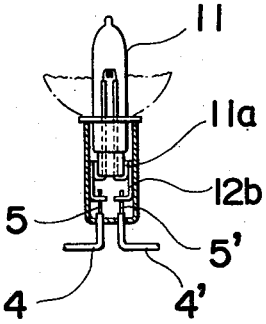
FIG. 8 is a side elevation showing the miniature electric light bulbs partially in cross section.

Also, in FIG. 2, reference numerals 11 and 11' denote miniature electric light bulb groups connected in series to the systems of electric wires 4 and 4', and as a whole, the groups from a parallel circuit. In this case, the electric bulbs are fitted detachably to husk portions 12 and 12', and lead wire **11*a* of the electric bulb contacts terminals 12*b* mounted on the leads 5 and 5' to form a circuit (refer to FIG. 8**).

Now, the operation of this invention will be described as follows.

The attachment plug of the miniature electric light bulb set for decoration is plugged into the power source to provide electric current to the electric wires 4 and 4' through the connection branching portion 7 from the electric wires 2 and 2' thereby to light up the miniature electric light bulb groups 11 and 11' which are connected in series. In this case, since the miniature electric light bulb groups are disposed as a whole in a parallel circuit, the flashing actions of each unit of the miniature electric light bulbs are different, and as a whole, two sets of the electric light bulb groups have alternate and staggered flashing times which demonstrate decorative effects.

Since the connection branching portion 7 is molded with the synthetic resin material to form the sleeve 9, no damage is inflicted upon the inside connection system even if it is handled roughly.

As described in the foregoing, this invention has a construction such that a plurality of miniature electric light bulb groups are connected and has been achieved by dividing a process of operations in the manufacture, simplifying the operations and components, connecting a plurality of resultant miniature electric light bulb groups in series, forming the groups in a parallel circuit as a whole, whereby the electric light bulb groups perform appropriate flashing actions unit by unit, producing excellent decorative illumination being different from the typical monotonous illuminating manner. Moreover, the connection branching portion is molded with a synthetic resin material, which provides excellent insulation and safety as well as good appearance. Since the miniature electric light bulb groups are connected in series to single electric wires branched in parallel, the connection of two pieces of electric wires to the husk portions holding the miniature electric light bulbs is only required which results in a simple body. Moreover, a so called three-way socket as shown in FIG. 1B is no longer needle, and cost of manufacture of parts for manufacturing the crimp type terminal and cost of installation are lowered which are excellent features of the present invention.

I claim:

1. A miniature electric light bulb set for decorative illumination which comprises two electric wires leading from an attachment plug, and leads of each electric wire being connected to the leads of two separate electric wires through a branch plate, the entire branch plate being molded with a synthetic resin material to form a sleeve, a first group of miniature electric light bulbs being connected in series to a system of the separate electric wires and a second group of miniature electric bulbs being similarly connected in series to the system of separate electric wires, and both groups of the miniature electric light bulbs being formed in a parallel circuit.

* * * * *